US005535940A

United States Patent [19]

Olds

[11] Patent Number: 5,535,940

[45] Date of Patent: Jul. 16, 1996

[54] CONTAINER FOR PIZZAS OR THE LIKE

[75] Inventor: David J. Olds, Kilbourne, Ohio

[73] Assignee: Willamette Industries Inc., Portland, Oreg.

[21] Appl. No.: 463,751

[22] Filed: Jun. 5, 1995

[51] Int. Cl.[6] ..... B65D 5/22; B65D 5/66

[52] U.S. Cl. ..... 229/110; 229/149; 229/150; 229/178; 229/906

[58] Field of Search ..... 229/110, 126, 229/128, 149, 150, 153, 178, 906, 160.2

[56] References Cited

U.S. PATENT DOCUMENTS

| | | | |
|---|---|---|---|
| 2,128,893 | 9/1938 | Bergstein | 229/160.2 |
| 2,736,487 | 2/1956 | George | 229/126 |
| 2,751,138 | 6/1956 | Laver | 229/178 |
| 2,834,532 | 5/1958 | Roepke | 229/160.2 |
| 4,620,666 | 11/1986 | Lacasa et al. | 229/149 |
| 4,714,190 | 12/1987 | Morrocco | 229/126 |
| 4,979,667 | 12/1990 | Seaman | 229/178 |
| 5,118,032 | 6/1992 | Geho | 229/110 |
| 5,211,329 | 5/1993 | Patton | 229/110 |
| 5,358,173 | 10/1994 | Mertz | 229/110 |
| 5,431,333 | 7/1995 | Lorenz | 229/149 |

FOREIGN PATENT DOCUMENTS

| | | | |
|---|---|---|---|
| 2424192 | 11/1979 | France | 229/149 |
| 442135 | 1/1968 | Switzerland | 229/160.2 |
| 326006 | 3/1930 | United Kingdom | 229/160.2 |
| 8807005 | 9/1988 | WIPO | 229/160.2 |

*Primary Examiner*—Gary E. Elkins
*Attorney, Agent, or Firm*—Francis T. Kremblas, Jr.

[57] ABSTRACT

A container board for flat food products, made from a single piece of paper board such as a pizza, which includes a bottom wall surrounded by upright side walls and a pair of diagonally extending front corner walls is described and includes a lid portion having a top wall connected to a rearwardly disposed side wall of said bottom wall by a fold line forming a hinge. The lid portion is movable between a closed position covering the bottom wall and an open position. The lid walls are formed of a double ply having an upper edge provided with a top opening recess. The lid portion includes a top wall and said walls, the latter being conformed to be received in closely spaced relationship to the inner surfaces of the upright bottom side walls when the lid portion is in the closed position. A pair of tabs extending outwardly from opposing edges of the lid top wall are configured and aligned to be received with a respective recess provided in the upper edge of the bottom corner walls in a friction fit relationship to releasably lock the lid portion in a closed position.

4 Claims, 6 Drawing Sheets

CONTAINER FOR PIZZAS OR THE LIKE

TECHNICAL FIELD

The present invention relates generally to paperboard containers for food products and more particularly to such containers which are suitable for relatively flat food products such as pizza.

BACKGROUND ART

The pizza industry has grown very rapidly over the past two decades to become one of the leaders in the food service industry for carry-out orders or actual delivery to the customer's location. After cooking, the pizza is inserted into a paperboard container for pick-up by the customer at the store location or, in some cases, delivery to the customer's location. Such containers are fabricated from a single paperboard blank which includes a variety of fold lines to permit the blank to be folded into the final container configuration for holding the pizza in a secure manner for transport.

Prior art containers primarily consist of rectangular, octagonal and six-sided versions wherein the front corners of a normally rectangular shape are replaced by a diagonal corner wall. The rectangular shaped container has been the configuration most often used in the past, however, since most pizzas are made in a generally circular shape, there is a waste of corner space and consequent waste of paperboard material. This material waste has become a concern due to the tremendous competition in the pizza industry, particularly between large pizza chains which consume a high volume of paperboard pizza containers.

Therefore there has been considerable attention directed over the last several years to new paperboard container designs for the pizza industry which attempts to reduce the amount of paperboard material while maintaining the necessary strength required to securely carry a pizza. Additionally, it would be advantageous to incorporate a latch or releasable locking means to secure the lid portion of the container in the closed position in an economical manner which also makes erecting and closing the box easier for employees at the pizza store location.

Examples of prior art paperboard containers of the type referred to herein are found in the following U.S. Pat. Nos. 5,118,032; 5,110,039; 5,263,634; 4,809,908 and 5,211,329. While these prior paperboard containers are directed to improving the features of such boxes or reducing material costs, further improvement in these areas is a desirable and advantageous goal.

BRIEF DISCLOSURE OF INVENTION

The container of the present invention comprises a paperboard blank provided with fold lines facilitating its erection into a receptacle having a bottom wall surrounded by side walls and a lid portion which is hinged along a rear fold line between an open position and a closed position overlying, but spaced from, the bottom portion of the receptacle. The lid portion includes a top wall and pair of opposing side walls which are extended downwardly in the folded condition from the top wall. A portion of the side walls preferably engage the bottom wall and support the lid top wall above the bottom wall to create space for the pizza.

The bottom portion includes a bottom wall, opposing bottom side walls and a bottom rear wall of single ply thickness. A pair of opposing front corner walls which extend diagonally between the bottom front wall and side walls are provided with folded over portions forming a double ply thickness and cooperate with flap portions joining the front and corner walls to strengthen the erected container structure.

The top or upper edge of each of the double ply corner walls include a recess having a top opening and bottom edge which is configured to receive a horizontally extending tab, provided on the leading or front edge of the lid top wall, in a close-fit relationship to form a releasable lock securing the lid in a closed position.

DETAILED DESCRIPTION OF PREFERRED EMBODIMENTS

Figure 1:
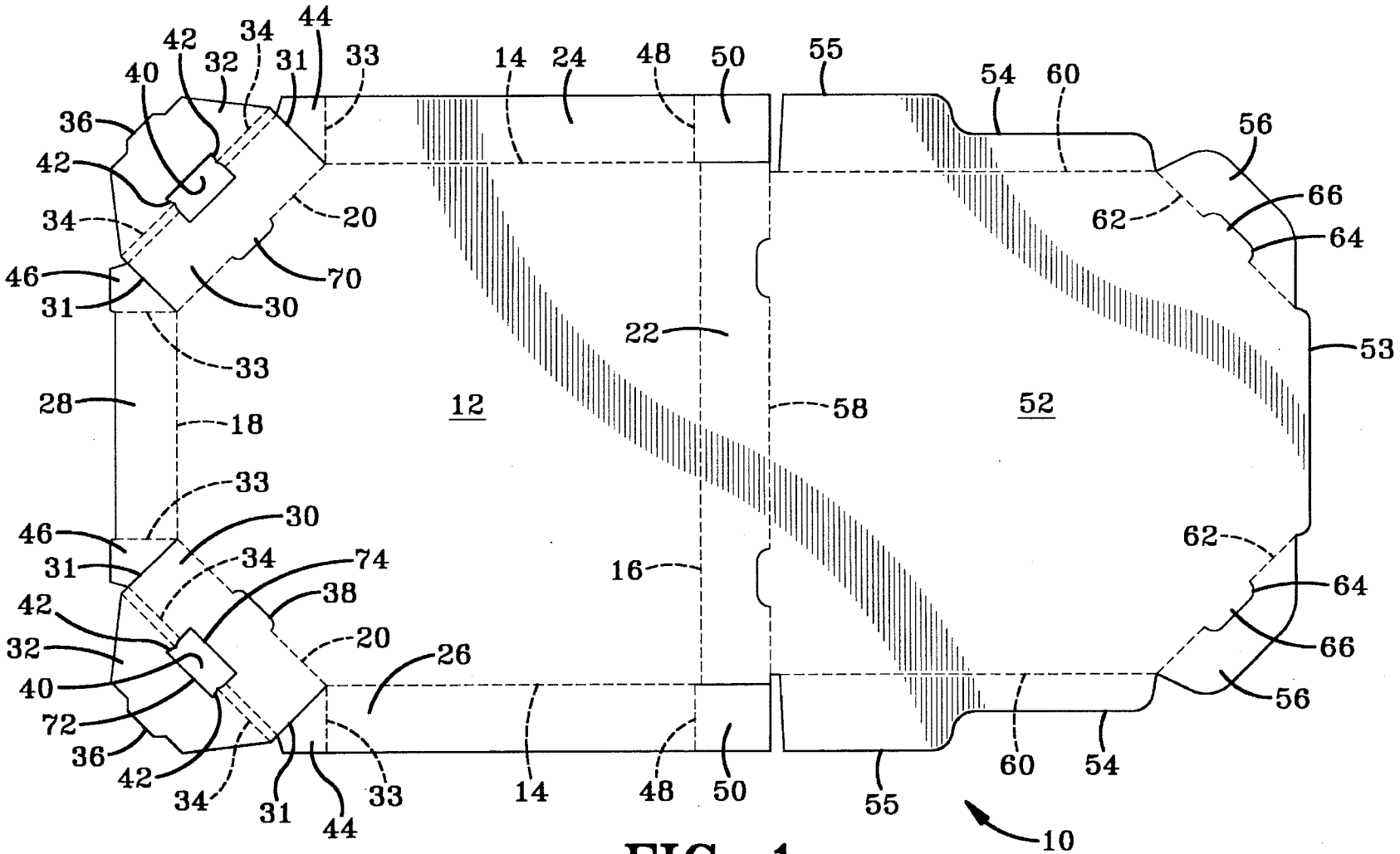
FIG. 1 is a plan view of a paperboard blank illustrating the fold lines for construction of a preferred embodiment of a container constructed in accordance with the present invention.
Figure 2:
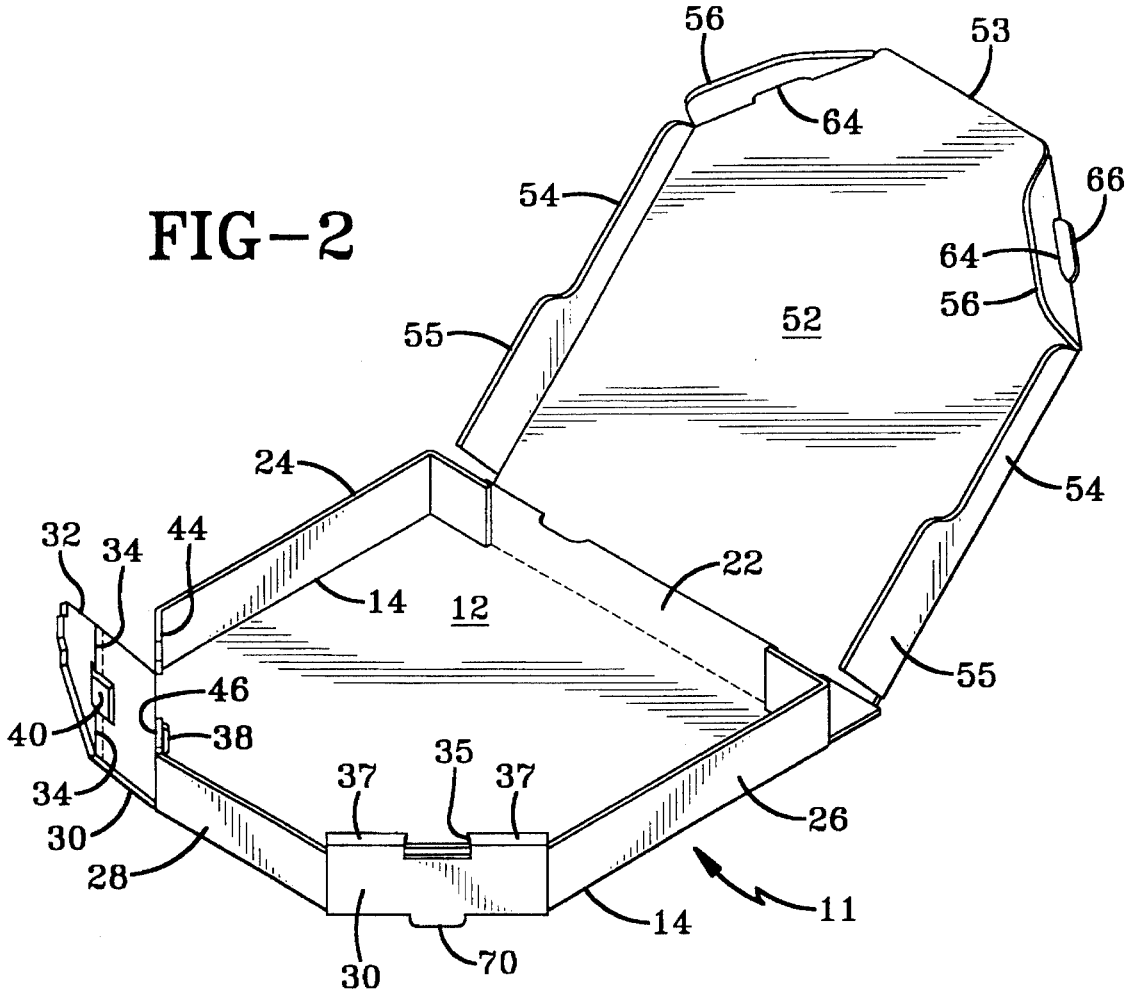
FIG. 2 is a perspective view of a container partially erected from the blank shown in FIG. 1 and in an open position.
Figure 3:
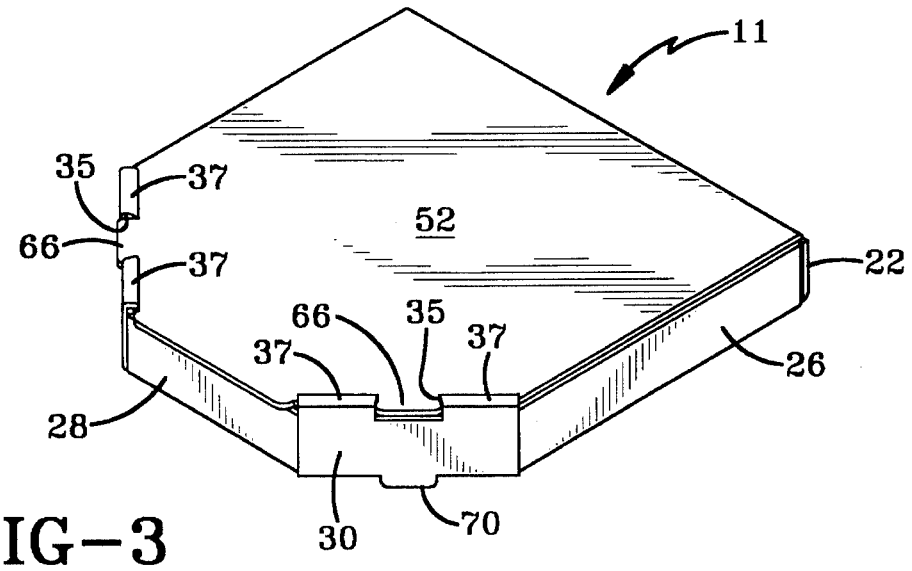
FIG. 3 is a perspective view of the container shown in FIG. 2 fully erected in a closed position.
Figure 4:
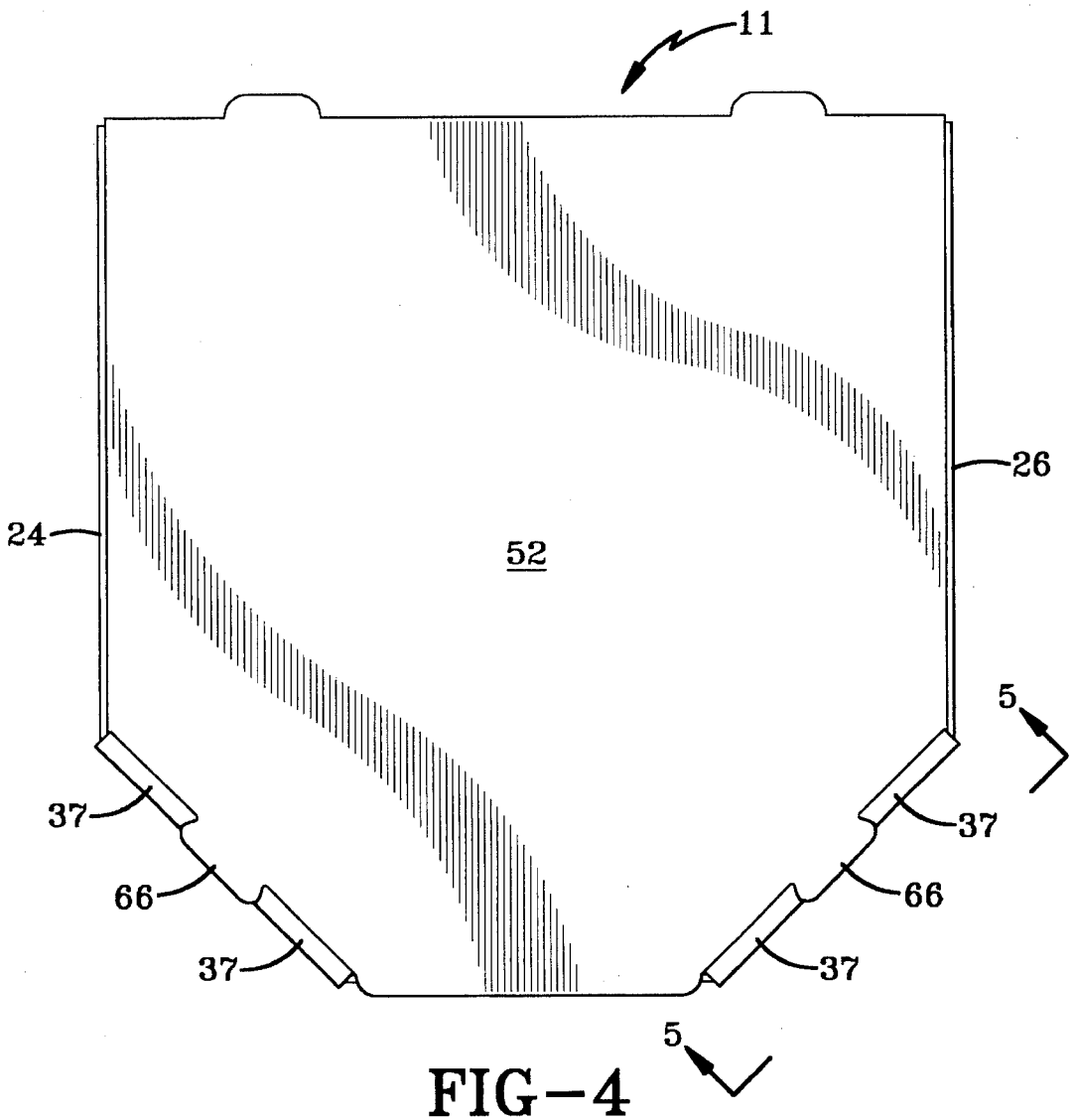
FIG. 4 is a top plan view of the container shown in FIG. 3.

A container for holding a flat food product, such as a pizza for example, constructed in accordance with the present invention is shown in FIGS. 1–6. With reference to FIG. 1, a paperboard blank, indicated generally at 10, is provided with various fold lines which permit one to quickly erect a container from blank 10, such as shown in FIGS. 2–4.

The container, indicated generally at 11, has a bottom portion comprising a bottom wall 12 defined by side fold lines 14, rear fold line 16, front fold line 18, and a pair of front corner fold lines 20, the latter extending diagonally between one of the side fold lines 14 and front fold line 18.

Fold lines 14–20 define the edges of bottom wall 12 and upstanding side walls 22, 24, 26, 28 and corner walls 30 which are formed by folding these portions about the respective fold lines to form an enclosure around bottom wall 12.

Each corner wall 30 includes an outwardly extending flap portion 32 which folds along a pair of fold lines 34 to overlap the corner wall portion 30 to form a double ply thickness to the corner wall providing additional strength and stiffness to the container 11 in its fully constructed position as seen in FIGS. 2–4.

Upon folding container blank 10 along the fold lines described above, the side and corner walls extend upwardly from the outer edges of bottom wall 12 at generally a right angle relative to bottom wall 12. Corner walls 30 extend diagonally between side walls 24, 26 and front wall 28.

Upon folding each corner wall portion 32 along fold lines 34 in overlapping relationship to side wall portion 30, wall portion 32 extends downwardly generally parallel to the inner side of wall portion 30. The outer edge of wall portion 32 is provided with an outwardly extending tab portion 36 which is configured to fit within an opening formed by an arcuate slit 38 provided in bottom wall 12 adjacent to corner wall portion 30 to maintain corner wall portions 30 and 32 in the overlying folded condition which also supports the adjoining side walls 14 and 18 in their upright folded position upon erecting the container 11.

Figure 5:
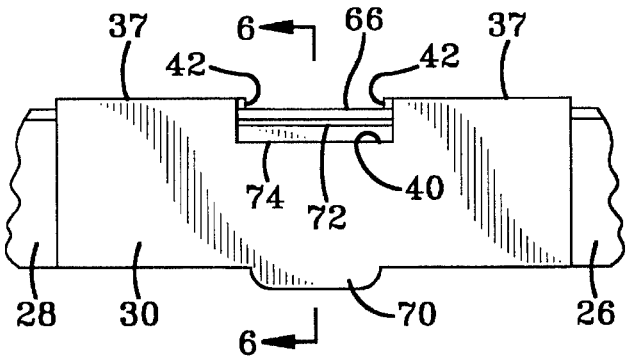
FIG. 5 is a partial front view illustrating one of the diagonal front corner walls of the container shown in the preceding drawings.
Figure 6:
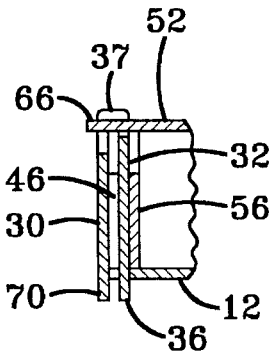
FIG. 6 is a partial side sectional view of one of the diagonal front corner walls such as shown in FIG. 5, the section being taken along line 6—6 in FIG. 5.

Each of the corner wall portions 30 and 32 are also provided with a cut-out portion 40 intersected by fold lines 34. Upon folding corner wall portion 32 over corner wall portion 30, a horizontally extending recess 35 is formed which interrupts the upper edge 37 of each of the corner walls such as best seen in FIGS. 2, 5 and 6. As seen in those figures, a slightly greater area of cut-out portion 40 is formed in wall portion 30 compared to wall portion 32. The portion of cut-out portion 40 formed in wall portion 32 includes upwardly extending opposing edges 42 which are preferably tapered to provide a narrowed opening in the fully erected condition for purposes described in detail later herein.

As best seen in FIG. 1, the side edges 31 of each corner wall portion 30 are at right angles to fold lines 34 and are separated from the side walls 24 and 26 during manufacture. A fold line 33 is formed at a right angle to the joinder of each side edge 31 to fold lines 14 and fold line 18 to form flap portions 44 and 46. Upon folding, flap portions 44 and 46 can be inserted between the folded corner wall portions 30 and 32 to closely join side walls 18, 24 and 26 with the corner walls in a fully erected condition as best shown in FIGS. 2 and 3.

Near the rear end of each side walls 24 and 26 which are separated by the lid portion, another fold line 48 is provided to form flap portions 50. Flap portions 50 are provided inwardly of bottom rear wall 22 and into overlapping relationship with the inner surface of a respective side walls 24 and 26 upon closing the lid portion which is described below.

A lid portion comprises a lid top wall 52, lid side walls 54 and optional lid corner walls 56. The rear edge of top wall 52 is defined by fold line 58 which also defines the top edge of bottom side wall 22 and forms a hinge about which the lid portion pivots between an open and closed position. Lid top wall 52 includes a front edge 53 configured to closely adjoin the upper edge of bottom front wall 28 between the corner walls in the closed position. Side fold lines 60 and diagonally extending corner fold lines 62 permit folding blank 10 in a manner to erect lid side walls 54 and corner walls 56 at about a right angle to lip top wall 52. Diagonally extending corner fold lines 62 define a diagonal corner edge of top wall 52.

Lid corner walls 56 tend to add strength to the bottom corner walls when the container is in the closed position but are not essential as will be understood in connection with the description of another preferred embodiment shown in FIGS. 7–12.

An arcuate slit 64 located adjacent to each corner fold line 62 has its opposing ends intersecting a respective one of fold line 62 and defines a tab 66 which forms an outward extension of lid top wall 52. Upon folding each lid corner wall 56 about a fold line 62, the tabs 66 are formed and are configured to be aligned with and frictionally fit with the width of recess 35 as best seen in FIGS. 3–6, to form a releasable latching or locking means when the lid portion is pivoted toward the bottom wall 12 to dispose the lid portion in a closed position overlying but spaced from bottom wall 12.

As best seen in FIGS. 1 and 3, the upwardly extending edges 42 of recess 35 are preferably tapered inwardly to narrow the top opening of recess 35 to increase the frictional engagement with the tab 66 upon closing the lid portion. This more securely holds the lip top wall 52 in a closed position to prevent inadvertent opening of the container. Since tab 66 is an extension of lid top wall 52 and extends parallel to lid top wall 52, secure closing of the lid portion may be accomplished in a quick and easy manner upon closing the lid portion. The forward edge of each tab 66 extends slightly beyond the confines of recess 35 and the outer surface of the bottom corner wall portions 30, so that one may release each tab 66 very easily by lifting the front edge of tab 66 to free it from each recess 35 and then pivot the lid portion to an open position. Reclosing the container is simply accomplished in the same manner as previously described above.

As best seen in FIG. 1, fold lines 60 are located slightly inside fold lines 14 such that lid side walls 54 closely fit on the inner side of bottom side walls 24 and 26 upon closing the lid portion. It is preferred that at least a portion of lid side walls 54 such as shown at 55, are deep enough to rest upon bottom wall 12 in the closed position to further support lid top wall 52 in a spaced relationship from bottom wall 12. With tab 66 disposed in recess 35 in the closed position and lid side wall portions 55 engaging bottom wall 12, both the front and rear of lid top wall 52 is very adequately supported in a spaced condition relative to bottom wall 12 and a pizza resting thereon while saving the amount of paperboard material needed to fabricate the container. When lid corner walls 56 are included, they also tend to aid in supporting lid top wall 52 in this spaced relationship to bottom wall 12 in the closed position.

Now referring specifically to FIGS. 5 and 6, a more detailed structural relationship of the double ply bottom corner wall portions 30 and 32 with tab 66 inserted within recess 35 is shown. A small tab 70 extending downwardly from corner portion 30 as seen in FIGS. 2, 3, 5 and 6, is formed upon folding each corner portion 30 along fold line 20. This folding action carries the material separated by slit 38 with corner portion 30 to form tab 70 and also create the opening in bottom wall 12 which receives tab 36 formed on the outer edge of corner wall portion 32.

FIGS. 5 and 6 also illustrate the unequal areas of slot or opening 40 located on opposite sides of fold lines 34 which create a bottom edge 72 of recess 35 associated with corner wall portion 32 which is disposed higher than the bottom edge 74 of recess 35 associated with corner wall portion 30. Therefore upon closing the lid portion, the higher edge 72 of recess 35 forms a stop limiting the depth each tab 66 can enter a respective recess 35. Edge 71 is preferably disposed generally horizontally and aligned with the upper edges of front wall 28 and side walls 24 and 26 such that lid top wall 52 and tabs 66 are disposed in generally the same place when the lid portion is in the closed position.

Now specifically referring to FIGS. 7–12, another preferred embodiment of the present invention is illustrated. The only difference between the embodiment shown in FIGS. 1–6 and that shown in FIGS. 7–12 resides in the elimination of the lid corner walls 56, the remainder of the blank and erected container is identical. For purposes of brevity, it is believed that one of ordinary skill in the art can fully understand the embodiment shown in FIGS. 7–12 without repeating the earlier description herein by merely using the same reference numerals followed by the designation "a" to identify the features or components in the embodiment shown in FIGS. 7–12 which are identical to those already described in regard to that shown in FIGS. 1–6. Any changed portions are identified by a new reference number specifically described herein.

Figure 7:
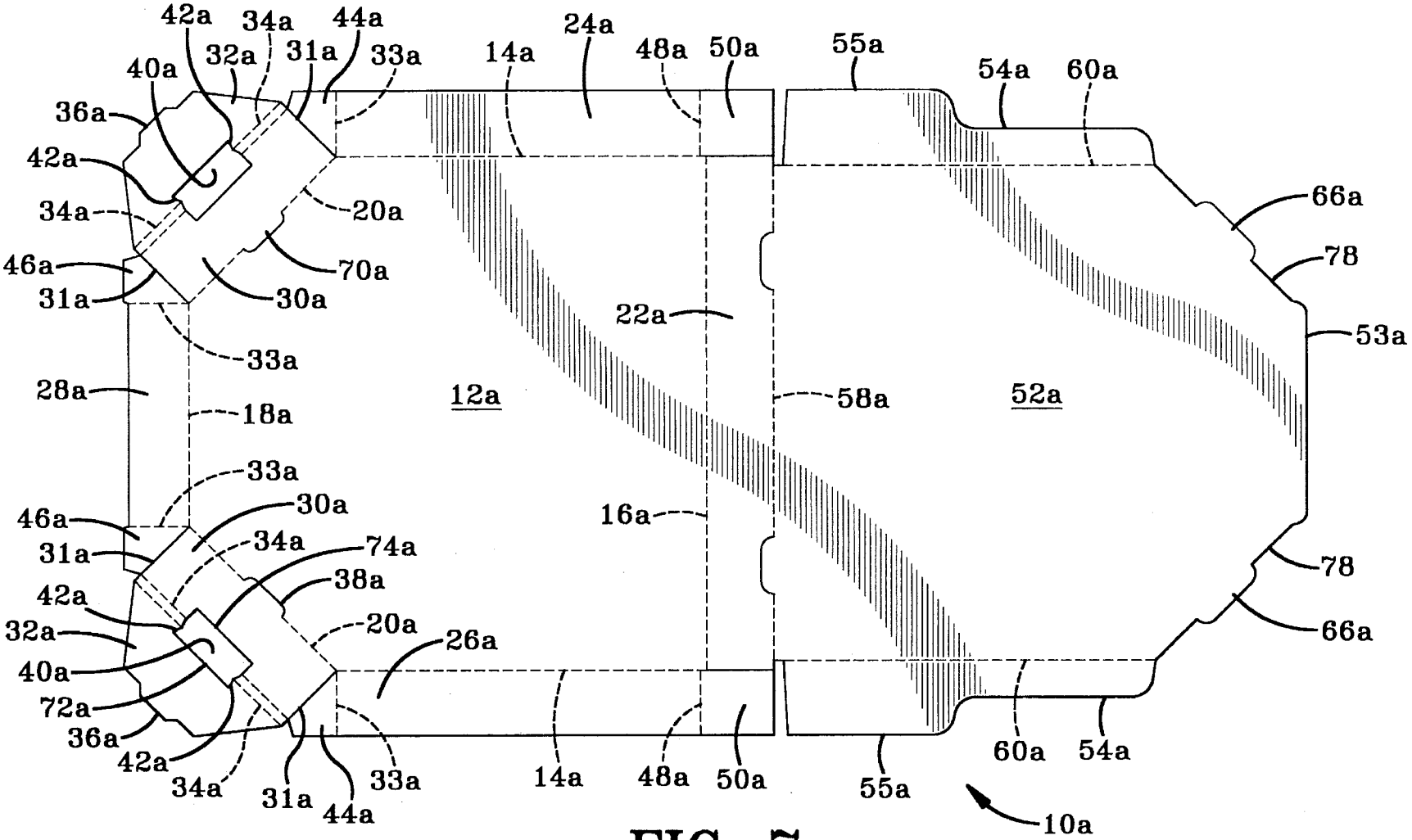
FIG. 7 is a plan view of a paperboard blank illustrating the fold lines for construction of another preferred embodiment of a container constructed in accordance with the present invention.
Figure 8:
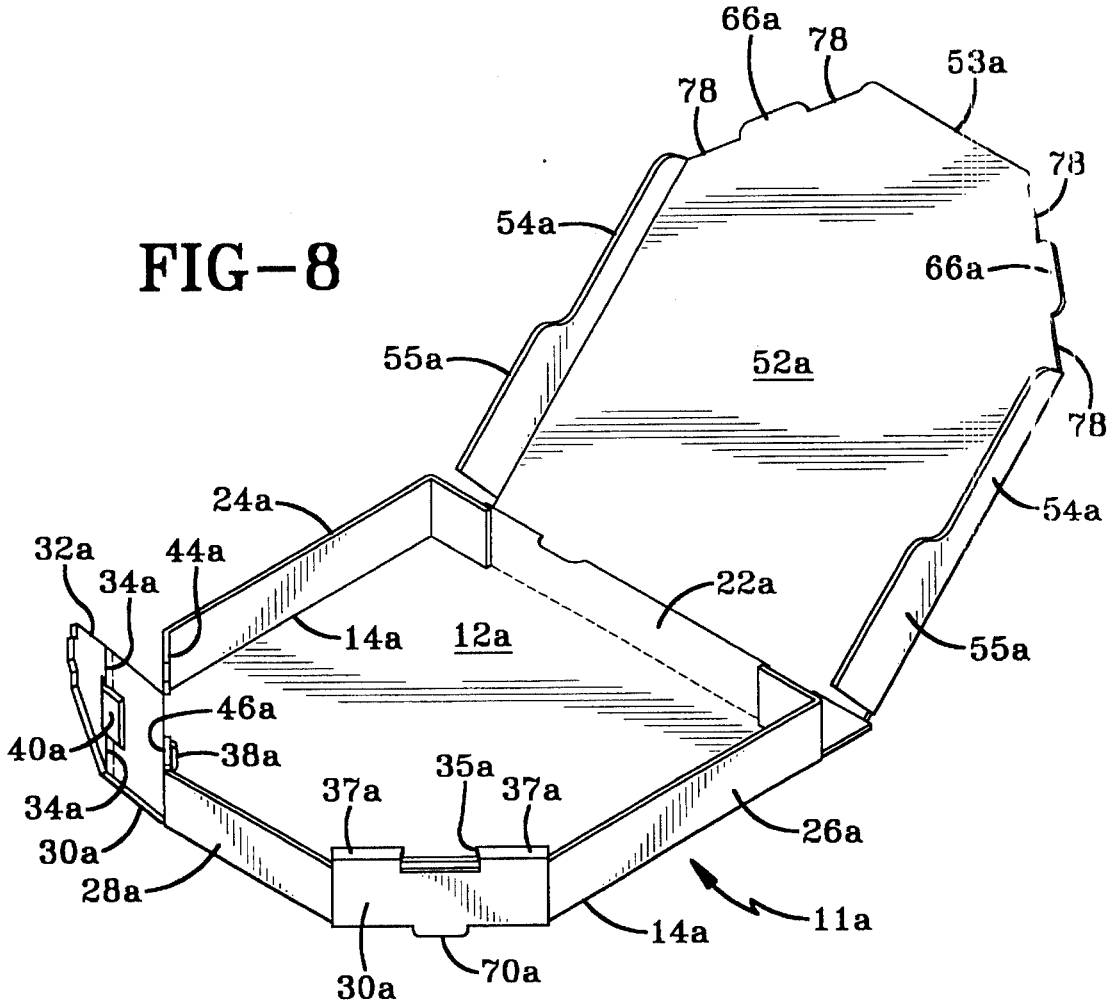
FIG. 8 is a perspective view of a container partially erected from the blank shown in FIG. 7 and in an open position.
Figure 9:
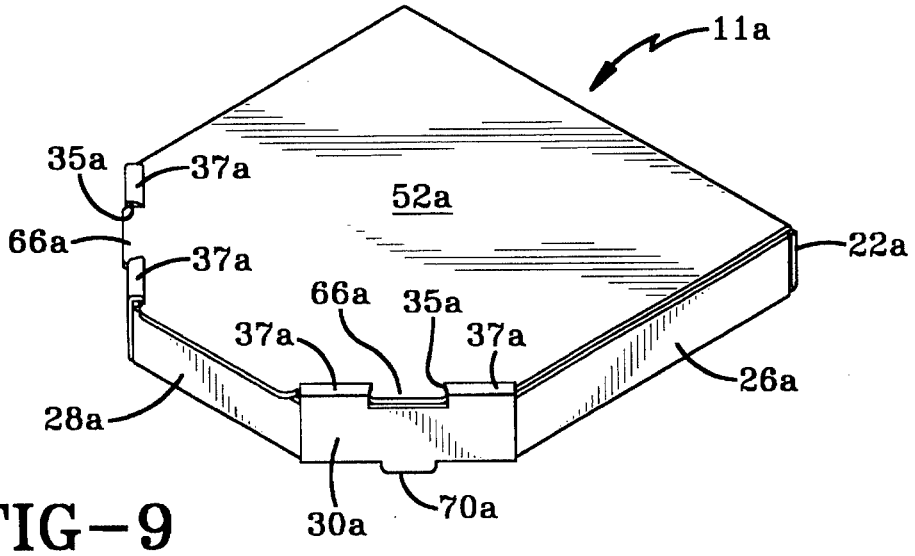
FIG. 9 is a perspective view of a container shown in FIG. 8 fully erected in a closed position.
Figure 10:
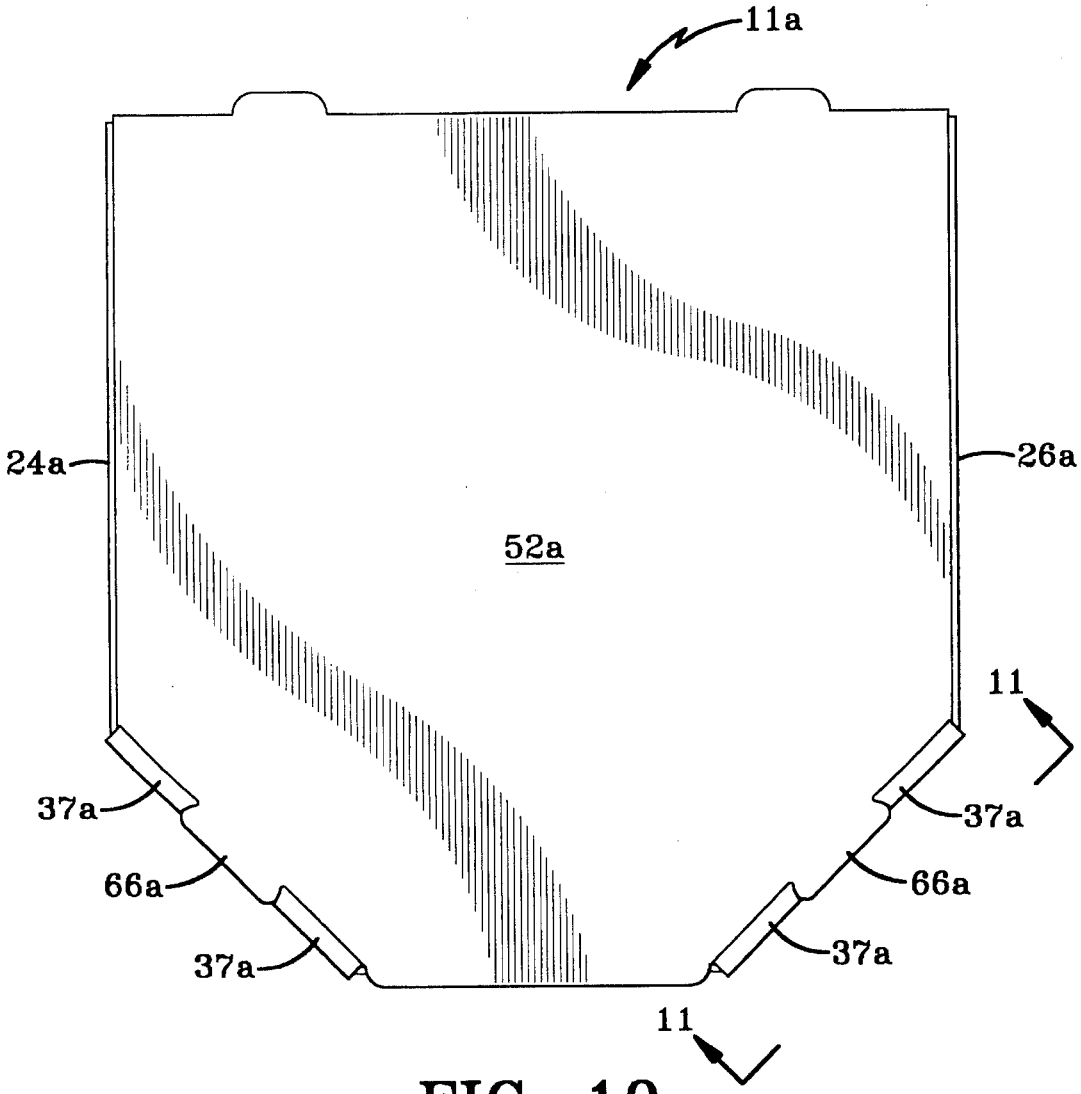
FIG. 10 is a top plan view of the container shown in FIG. 9.
Figure 11:
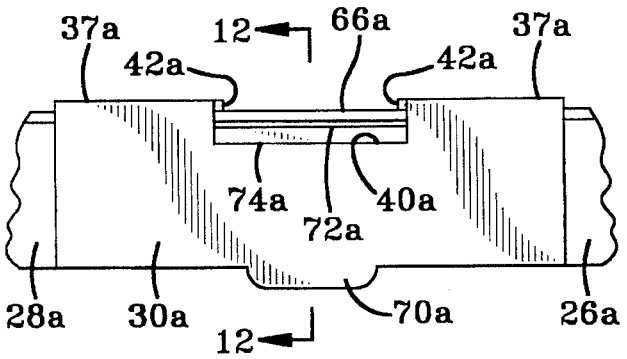
FIG. 11 is a partial front view illustrating one of the diagonal front corner walls of the container shown in FIG. 10.
Figure 12:
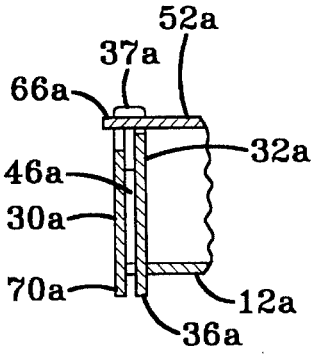
FIG. 12 is a partial side sectional view of the diagonal front corner wall shown in FIG. 11, the section being taken along line 12—12 in FIG. 11.

Now referring to the paperboard blank indicated generally at 10-*a* in FIG. 7, lid top wall 52-*a* is provided with diagonally extending edges 78 which extend between opposing ends of front edge 53-*a* and one end of each side fold line 60-*a* which defines a respective lid side wall 54-*a*. Essentially diagonal edges 78 are formed in the same location as the fold lines 62 in the embodiment of FIGS. 1–6.

Diagonal edges 78 each include an outwardly extending tab 66-*a* which functions in the same manner as its counterpart tab 66 in the embodiment shown in FIGS. 1–6 to frictionally fit within recess 35-*a* of the embodiment shown in FIGS. 1–7.

One of the advantages of the embodiment shown in FIGS. 7–12 is the elimination of the diagonally extending side walls 56, which are shown in the embodiment of FIGS. 1–6. Without side walls 56, one may manipulate the construction, loading and closing of the container in a faster and easier manner. It should be pointed out that in operation of a pizza establishment, the saving of even 10 to 30 seconds in the process of boxing a pizza represents a significant value, particularly during high volume order periods when time is the essence.

In the embodiment shown in FIGS. 7–12, constructing the container 11-*a* from the paperboard blank 10-*a*, elimination of the folding step required to form lid corner walls 56 and the need to insert walls 56 inside the bottom corner walls, represents a relatively small, but valuable time savings.

As earlier mentioned herein, the lid corner walls 56 shown in FIGS. 1–6 are optional, but do provide a degree of support to maintain lid top wall 52 in a spaced relationship with bottom wall 12. However, the tabs 66 and 66-*a* not only function to releasably lock the lid portion in closed position in a quick and easy manner, but also function to strengthen or add rigidity to the bottom corner walls when snapped into engagement with recesses 35 or 35-*a*. Further, tabs 66 or 66-*a* also provide adequate support to maintain the forward end of lid portion in a spaced relationship from bottom wall 12 or 12-*a* when disposed in a fully closed position.

In view of the foregoing description, it should be understood by those skilled in the art that a container constructed in accordance with the present invention represents an improvement over similar prior art pizza containers of this type by preserving the economical use of paperboard material in a design which provides a releasable locking feature which is functionally easier and quicker to erect and use by those in the pizza food industry.

I claim:

1. A container for a generally flat food product formed from a single piece of paperboard blank comprising;

a) a bottom wall defined by a pair of side fold lines, a rear fold line, a front fold line and a pair of diagonally extending corner fold lines, each corner fold line connecting one of said side fold lines to a respective one of opposing ends of said front fold line;

b) an upright bottom side wall extending upward from said bottom wall along each of said side fold lines, said rear fold line, and said front fold line and an upright bottom corner wall extending upward from said bottom wall along each of said diagonally extending corner fold lines to form an enclosure surrounding said bottom wall;

c) a pair of arcuate slots disposed in said bottom wall, a respective one of said slots being disposed adjacent to and intersecting a respective one of said corner fold lines and including an edge provided with a vertically depending tab extending downwardly beyond the plane of said bottom wall;

d) each of said bottom corner walls including an outwardly extending flap portion having an inner edge defined by a pair of adjacent, parallel extending fold lines, an opposing free edge provided with an outwardly extending tab portion and a cut-out area intersecting and extending beyond each of said adjacent, parallel extending fold lines, a respective one of said flap portions being folded over a respective one of said upright bottom corner walls along said adjacent parallel fold lines to form a double ply having an upper edge and wherein said cut-out area forms a top opening recess in said upper edge having a predetermined width and depth, with said tab on said free edge being directed downwardly and through one of said arcuate slots beyond the plane of said bottom wall to retain said double ply corner wall configuration in a folded upright condition;

e) a lid portion including a lid top wall connected to one of said side walls by a fold line forming a hinge for moving said lid portion between an open position uncovering said bottom wall and a closed position overlying said bottom wall, said lid top wall including a front edge, a pair of diagonally extending corner edges, and a pair of lid side walls extending generally at a right angle to said lid top wall between a rear edge of said top wall and a respective one of said diagonally extending corner edges;

f) each of said diagonally extending corner edges of said lid top wall including an outwardly extending tab portion extending generally parallel to said lid top wall, each of said tab portions configured to be received within a respective one of said recesses formed in the upper edge of a respective one of said bottom corner walls in a friction fit relationship disposed generally parallel to said top wall to releasably lock said lid portion in a closed position.

2. The container defined in claim 1 wherein each of said recesses in the upper edge of a respective one of said bottom corner walls includes tapered side edges defining a narrowed top opening.

3. The container defined in claim 1 wherein each of said tab portions formed along said diagonally extending fold lines adjacent to said lid corner walls includes a front edge extending horizontally outwardly beyond said recess when said lid portion is in said closed position forming a lip to facilitate removing each of said tabs from a respective one of said recess.

4. The container defined in claim 1 wherein said lid side walls are formed to fit generally parallel and closely adjacent to an inner surface of said bottom side walls and include at least a portion thereof having a depth sufficient to engage said bottom wall when said lid portion is in said closed position.

* * * * *